US009378918B2

(12) United States Patent
Darr et al.

(10) Patent No.: US 9,378,918 B2
(45) Date of Patent: Jun. 28, 2016

(54) METHOD OF MANUFACTURING A FUSE MODULE

(75) Inventors: Matthew R. Darr, Godfrey, IL (US); Jiehua Su, Shanghai (CN)

(73) Assignee: COOPER TECHNOLOGY COMPANY, Houston, TX (US)

( * ) Notice: Subject to any disclaimer, the term of this patent is extended or adjusted under 35 U.S.C. 154(b) by 0 days.

(21) Appl. No.: 13/215,571

(22) Filed: Aug. 23, 2011

(65) Prior Publication Data

US 2011/0314671 A1 Dec. 29, 2011

Related U.S. Application Data

(62) Division of application No. 12/179,829, filed on Jul. 25, 2008, now Pat. No. 8,026,786.

(51) Int. Cl.

| | |
|---|---|
| ***H01H 69/02*** | (2006.01) |
| ***H01H 85/20*** | (2006.01) |
| ***H01R 4/38*** | (2006.01) |

(52) U.S. Cl.

CPC ..... *H01H 85/203* (2013.01); *H01R 4/38* (2013.01); *Y10T 29/49107* (2015.01); *Y10T 29/49208* (2015.01)

(58) Field of Classification Search

CPC ... H01H 69/02; H01H 21/42; H01H 85/0417; H01H 9/22; H01H 2085/0034; H01H 5/06; H01H 85/147; H01H 85/20; H01R 4/38; H01R 43/16; H01R 4/2462; H02B 11/133

USPC ..... 29/623, 842, 874, 876; 337/180, 187, 337/188, 194, 198, 227, 251, 268

See application file for complete search history.

(56) References Cited

U.S. PATENT DOCUMENTS

| | | | | |
|---|---|---|---|---|
| 5,580,285 | A * | 12/1996 | Vanzetto | 439/810 |
| 6,157,287 | A | 12/2000 | Douglass et al. | |
| 6,784,783 | B2 * | 8/2004 | Scoggin et al. | 337/194 |
| 2008/0254688 | A1 * | 10/2008 | Bogursky et al. | 439/858 |

FOREIGN PATENT DOCUMENTS

| | | | |
|---|---|---|---|
| DE | 10152584 | A1 | 5/2002 |
| EP | 1711982 | B1 | 2/2008 |
| WO | 2005071793 | A1 | 5/2005 |

OTHER PUBLICATIONS

European Search Report of 09166300.5; Nov. 4, 2009; 6 pages.

* cited by examiner

*Primary Examiner* — Thiem Phan

(74) *Attorney, Agent, or Firm* — Armstrong Teasdale LLP

(57) ABSTRACT

A method of manufacturing a fuse module includes forming a fuse clip member from a single, substantially planar piece of electrically conductive material to include a pressure plate, and assembling the pressure plate with a box lug and a securing member, wherein operating the securing member causes the box lug to move relative to the pressure plate.

13 Claims, 7 Drawing Sheets

METHOD OF MANUFACTURING A FUSE MODULE

CROSS REFERENCE TO RELATED APPLICATIONS

This application is a divisional application of U.S. patent application Ser. No. 12/179,829 filed Jul. 25, 2008 now U.S. Pat. No. 8,026,786, the disclosure of which is hereby incorporated by reference in its entirety.

TECHNICAL FIELD

This invention relates generally to fuses and to wiring lugs used in fuse modules. More particularly, the invention relates to an improvement of the wiring lugs used by fuse modules to provide a connection between a terminal element and an electrical lead.

BACKGROUND OF THE INVENTION

Fuse modules provide a means for fuses to be incorporated into an electrical circuit. Typically, a fuse module has two terminals for electrical leads and two terminals for a fuse connection. The mechanism that has typically been used to connect electrical leads to fuse connections has been the wiring lug, which contains electrical lead terminals and fuse clip terminals. A load side electrical lead is attached to a first lead terminal. A line side electrical lead is attached to a second lead terminal. The circuit through the fuse module then may be completed by the installation of the fuse in the fuse terminal, which electrically connects the line side and load side lead terminals through the fuse element.

Previous wiring lugs have used screw terminals where the electrical leads couple to the lead terminals via the use of screws. The electrical leads are brought into contact with the screws while in a first position. The screws are then placed in a second position, creating an electrical and mechanical connection between the electrical leads and the screw by arresting the leads between the screw and a surface. These connections may be formed by placing the lead under the head of the screw and the screw head coming in contact with a surface. Alternatively, these screw terminals may involve the electrical lead being wound around the screw terminals and the screw rotating to the surface. Alternatively, the screw could press the electrical lead to the terminal by directly applying physical pressure at the base of the screw. These previous methods led to problems with heat transfer and electrical resistance. Additionally, high torque is needed to secure the electrical leads to the screw terminals, which is a problem in itself and which may damage the leads. Additional features of previous embodiments included securing devices that have congruent teeth flanking either side of the electrical lead, leading to the possibility of damaging the leads during installation.

An additional problem with conventional lugs relates to the conductive materials used in wiring lugs. Clips used in such applications have been made of conductive materials that have inherent spring properties to them, such as C19025, C7025, or C7026, to provide the necessary physical properties to secure the fuses to the wiring lugs. In addition to the expense associated with such conductive materials, there is usually an amount of 'scrap' conductive material that is unused. This excess material has been undesirable as these devices used special copper alloys that are expensive. The use of these copper alloys also leads to the additional problem of requiring a hydraulic press because the conductive material is too strong to be manipulated with hand tools, thereby further increasing manufacturing costs.

Therefore, a need exists in the art for a wiring lug that can securely couple to both an electrical lead and a fuse terminal while making use of minimal conductive materials and labor.

BRIEF SUMMARY OF THE INVENTION

The invention relates generally to a wiring lug that can connect electrical leads and fuse terminals. This connection is facilitated by an improved fastening mechanism that couples the electrical lead to the wiring lug as will be described below.

The wiring lug according to the invention comprises a fuse clip that receives a fuse contact and a pressure plate that couples to an electrical conductor. A box lug moves with respect to the pressure plate to crimp the conductor between an interior of the box lug and the pressure plate. The crimping in this fashion can provide an increased area of electrical contact between the conductor and the pressure plate. One or more projections formed in the pressure plate can increase a holding strength of the wiring lug on the conductor. The projections also can maintain alignment of the pressure plate and the box lug by mating with corresponding apertures in the box lug. This wiring lug may be used in fuse holders as described below.

According to one aspect of the invention, a wiring lug can include a fuse clip member and a box lug. The fuse clip member comprises a fuse clip for receiving a contact of a fuse and a first pressure plate for contacting an electrical conductor. The box lug includes an opening into which the pressure plate of the fuse clip member is disposed, where the interior bottom surface of the box lug comprises a second pressure plate. A securing member determines movement of the box lug with respect to the fuse clip member. When the securing member that is operably coupled to the box lug is in a first position, the first pressure plate of the fuse clip member and the second pressure plate of the box lug are disposed in a non-clamping relationship and do not claim the conductor therebetween. When the securing member is in a second position, the first pressure plate and the second pressure plate are coupled by moving the box lug from a first position to a second position, thereby securing the conductor between them.

In accordance with another aspect of the invention, the wiring lug may be incorporated into a fuse module. Two wiring lug may be installed into a fuse module where a fuse may be installed into the wiring lugs to complete an electrical circuit. The wiring lugs used in the fuse module may receive an electrical conductor from either the line side or the load side, respectively, of an electrical circuit. The electrical conductors may then be separately coupled between the first pressure plate and the second pressure plate in one of the wiring lugs. A fuse may then be installed in the fuse module providing an electrical connection between the two fuse clips of the separate wiring lugs.

In accordance with yet another aspect of the invention, the fuse clip member may be formed from a single piece of conductive material. The fuse clip member formation beings with a primary member. A piece of the primary member that is substantially rectangular and located in the center of the primary member is split away on all but one side, forming a secondary member. The distal end of the secondary member is rotated such that at least a portion of the secondary member is substantially perpendicular to the primary member. The secondary member is configured to become the pressure plate. The primary member is then bent to form a fuse clip by disposing two ends of the primary member adjacent to each other. A spring is disposed around the two ends of the primary member to bias the two ends towards each other. This method of creating a fuse clip member allows for minimal generation of waste, while creating a single member that can receive a fuse contact and can act as a pressure plate used as an electrical conductor contact.

These and other aspects, objects, and features of the invention will become apparent to those having ordinary skill in the art upon consideration of the following detailed description of exemplary embodiments exemplifying the best mode for carrying out the invention as presently perceived.

BRIEF DESCRIPTION OF THE DRAWINGS

For a complete understanding of the invention and the advantages thereof, reference is now made to the following description in conjunction with accompanying figures in which.

Figure 2:
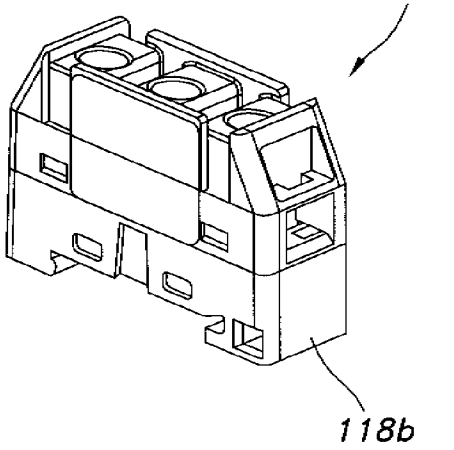
FIG. 2 is a perspective view of the exemplary fuse module illustrated in FIG. 1.

The appended drawings illustrate only exemplary embodiments of the invention and therefore do not limit its scope, as the invention may admit other equally effective embodiments.

DETAILED DESCRIPTION OF THE INVENTION

The invention may be better understood by reading the following description of non-limitative, exemplary embodiments with reference to the attached drawings wherein like parts of each of the figures are identified by the same reference characters.

Figure 1:
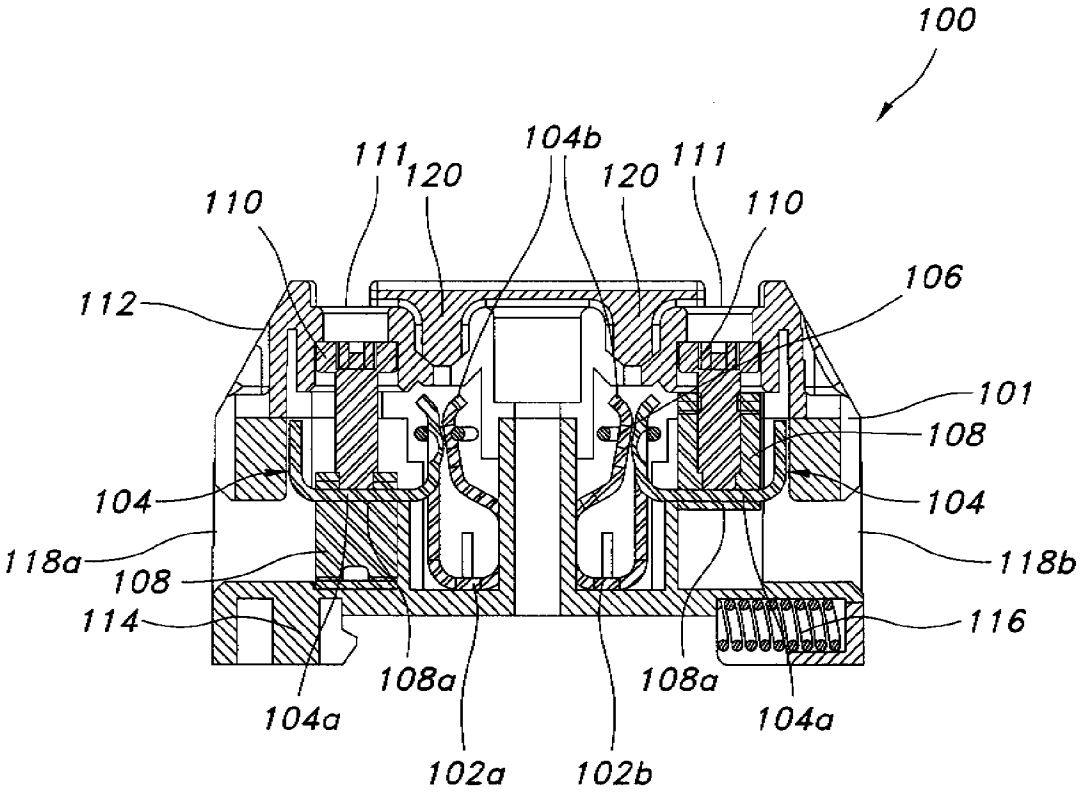
FIG. 1 is a cross sectional view of a fuse module that utilizes wiring lugs according to one exemplary embodiment of the invention.

With reference to FIGS. 1 and 2, an exemplary embodiment of a wiring lug disposed in a fuse module will be described. FIG. 1 is a cross sectional view of a fuse module 100 that utilizes two wiring lugs 102 (illustrated separately as wiring lugs 102*a* and 102*b* and collectively or individually referred to as wiring lugs 102) according to one exemplary embodiment of the invention. FIG. 2 is a perspective view of the exemplary fuse module 100 illustrated in FIG. 1.

Referring to FIG. 1, the fuse module 100 comprises a housing 101 in which the two wiring lugs 102*a*, 102*b* are disposed. The housing 101 is suitably formed to hold the wiring lugs 102*a*, 102*b* in position with respect to each other. Each of the wiring lugs 102 comprises a fuse clip member 104. The fuse clip member 104 comprises a pressure plate 104*a* and a fuse clip 104*b*. The fuse clip 104*b* comprises two members biased together by a backing spring 106.

Each of the wiring lugs 102 further comprises a box lug 108. Each box lug 108 comprises a pressure plate 108*a*. A screw-type fastener 110 is threadably coupled to the box lug 108 for moving the box lug 108 with respect to the pressure plate 104*a* of the fuse clip member 104. The fastener 110 is accessible via an aperture 111 in the fuse module 100. The aperture 111 is configured to hold the fastener 110 in a substantially fixed position with regard to the fuse clip member 104. As illustrated in FIG. 1, a diameter of the aperture 111 is smaller than a diameter of the fastener 110, thereby holding the fastener 110 in position with respect to the fuse clip member 104, and particularly with respect to the pressure plate 104*a* of the fuse clip member 104.

As illustrated in FIG. 1, the fuse module 100 includes two wiring lugs 102*a*, 102*b*. The box lug 108 in the first wiring lug 102*a* is in a first, open position, and the box lug 108 in the second wiring lug 102*b* is in a second, closed position. In the first, open position, the pressure plate 108*a* of the box lug 108 is spaced apart from the pressure plate 104*a* of the fuse clip member 104. In the second, closed position, the pressure plate 108*a* of the box lug 108 is disposed adjacent to the pressure plate 104*a* of the fuse clip member 104 such that a conductor (not shown) can be crimped between the pressure plates 104*a*, 108*a*.

In the exemplary embodiment illustrated in FIG. 1, electrical leads (not shown) can be coupled to the fuse module 100 though lead apertures 118*a*, 118*b* at either side of the fuse module 100. The lead aperture 118*a* receives a line side electrical lead for the wiring lug 102*a*. The line side electrical lead can be crimped between the pressure plates 104*a*, 108*a* of the wiring lug 102*a*. The lead aperture 118*b* receives a load side electrical lead for the wiring lug 102*b*. The load side electrical lead can be crimped between the pressure plates 104*a*, 108*a* of the wiring lug 102*b*.

For each wiring lug 102, the box lug 108 is moved from the first, open position to the second, closed position by turning the fastener 110. The fastener 110 mates with the box lug 108 such that turning the fastener 110 causes the box lug 108 to move up or down on the fastener 110. Since the fastener 110 and the pressure plate 104*a* of the fuse clip member 104 are substantially maintained in a fixed position with regard to each other, movement of the box lug 108 along the fastener 110 moves the box lug 108 with respect to the pressure plate 104*a* of the fuse clip member 104. Accordingly, the box lug 108 can move from the open position (illustrated with wiring lug 102*a* in FIG. 1) to the closed position (illustrated with wiring lug 102*b* in FIG. 1).

The fuse module 100 illustrated in FIG. 1 further includes a fuse receptacle 120 for receiving a fuse (not shown). The fuse engages the fuse clips 104*b* of the wiring lugs 102*a*, 102*b* to connect the two wiring lugs 102*a*, 102*b*, thereby completing the connection between the line side and load side electrical leads. In the illustrated, exemplary embodiment, the fuse receptacle 120 is disposed in a top portion 112 of the fuse module 100. A bottom portion 114 of the fuse module 100 includes structures to attach the fuse module 100 to other surfaces, such as an electrical box. For example, a DIN spring 116 provides a securing mechanism for the fuse module 100 to apply pressure to a DIN rail. Any suitable means for securing the fuse module 100 to a surface may be used, such as screws, clips, or other suitable devices.

Figure 3:
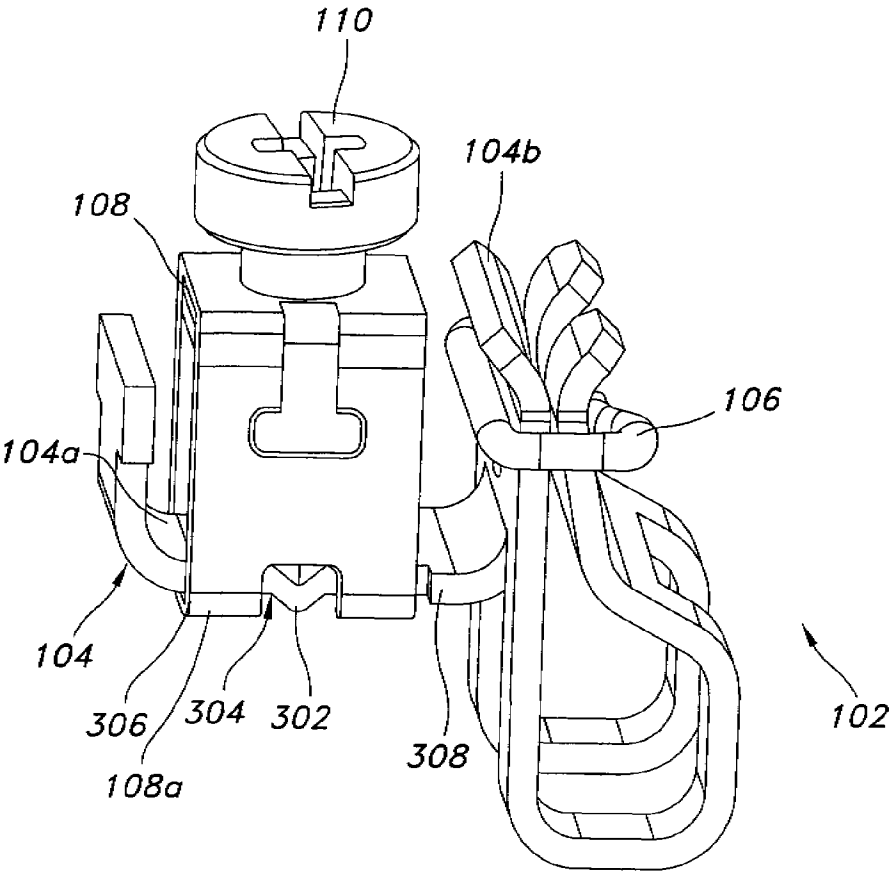
FIG. 3 is a partial elevation view of a wiring lug according to one exemplary embodiment of the invention.

FIG. 3 is a partial elevation view of the wiring lug 102 according to one exemplary embodiment of the invention. Referring to FIG. 3, the wiring lug 102 is in the closed position where the pressure plate 108*a* of the box lug 108 is disposed adjacent to the pressure plate 104*a* of the fuse clip member 104.

In this exemplary embodiment, the pressure plate 104*a* of the fuse clip member 104 comprises a projection 302 extending toward the pressure plate 108*b* of the box lug 108. As illustrated, the projection 302 comprises a v-shape. However, a semi-circular, square, or other suitable shape of the projection 302 is within the scope of the invention. Although not illustrated in FIG. 3, the pressure plate 104*a* of the fuse clip member 104 can comprise a similar projection on a side of the pressure plate 108*b* opposite the projection 302. In this embodiment, the projections in the pressure plate 104*a* create two "teeth" extending toward the pressure plate 108*a* of the box lug 108.

The box lug 108 further comprises an aperture 304 disposed in a position corresponding to the projection 302 of the pressure plate 104*a* of the fuse clip member 104. As illustrated, the aperture 304 is disposed in a side wall 306 of the box lug 108. The aperture 304 also is disposed in the pressure plate 108*a* of the box lug 108. While illustrated as semi-circular in shape, a v-shape, square, or other suitable shape of the aperture 304 is within the scope of the invention. Accordingly, the projection 302 of the fuse clip member 104 is visible and extends through the aperture 304 of the box lug 108. In an exemplary embodiment, the box lug 108 can comprise a second aperture on an opposite side of the pox lug 108 for receiving the second projection discussed previously.

In the exemplary embodiment illustrated in FIG. 3, the projection 302 provides additional strength to hold a conductor (not shown) that is crimped between the pressure plates 104*a*, 108*a*. The projection 302 can help maintain the position of the box lug 108 with respect to the fuse clip member 104. The projection 302 and the aperture 304 together from a pinch point within which the conductor can be secured. The pinch point secures the conductor with less torque exerted by the fastener 110.

In an alternative exemplary embodiment, the projection 302 can be a continuous projection extending across the pressure plate 104*a* of the fuse clip member 104. In this embodiment, a conductor may deform around the projection 302 when crimped between the pressure plates 104*a*, 108*a*, thereby providing additional holding strength to retain the conductor within the wiring lug 102.

FIG. 3 also illustrates the backing spring 106 attached to the fuse clip 104*b* of the fuse clip member 104. The backing spring 106 has a spring force that biases the two sides of the fuse clip 104*b* together. Such bias aids in securing a fuse terminal of a fuse to the fuse clip 104*b* when the fuse is installed in the fuse module 100 (FIG. 1).

The exemplary embodiment in FIG. 3 further illustrates a notch 308 in the pressure plate 104*a* of the fuse clip member 104. The notch 308 defines a transition from a first portion of the pressure plate 104*a* to a second portion of the pressure plate 104*a*. The first portion of the pressure plate 104*a* is wider than the interior dimension of the box lug 108. Accordingly, the pressure plate 104*a* of the fuse clip member 104 cannot be inserted into the box lug 108 past the notch 308. The second portion of the pressure plate 104*a* is narrower than the interior dimension of the box lug 108 to allow that portion of the pressure plate 104*a* to be inserted into the box lug 108.

Figure 4B:
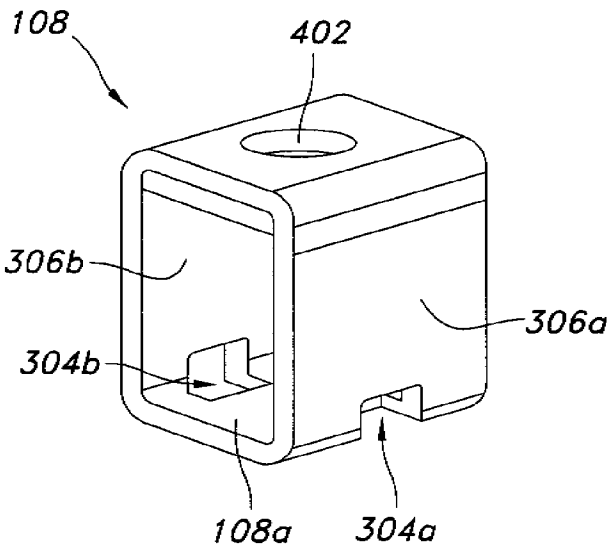
FIG. 4B is a partial elevation view of the box lug illustrated in FIG. 4A according to one exemplary embodiment of the invention.
Figure 4A:
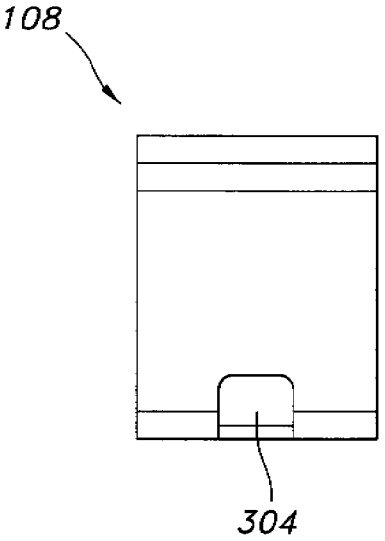
FIG. 4A is a side elevation view of a box lug of the wiring lug illustrated in FIG. 3 according to one exemplary embodiment of the invention.

With reference to FIGS. 4A and 4B, features of the box lug 108 will be described. FIG. 4A is a side elevation view of the box lug 108 of the wiring lug 102 illustrated in FIG. 3 according to one exemplary embodiment of the invention. FIG. 4B is a partial elevation view of the box lug 108 illustrated in FIG. 4A according to one exemplary embodiment of the invention. As depicted, a first aperture 304*a* is disposed on a first side wall 306*a* of the box lug 108. A corresponding aperture 304*b* is disposed on an opposite side wall 306*b* of the box lug 108. The apertures 304*a*, 304*b* also extend partially into the pressure plate 108*a*, which comprises the inner, lower surface of the box lug 108. The two apertures 304*a*, 304*b* are disposed to accommodate two projections 302 (FIG. 3) on the pressure plate 104*a* of the fuse clip member 104. When an electrical lead is placed between either of the two projections 306*a-b* and the corresponding apertures 304*a*, 304*b*, the securing pressure on the electrical lead is increased.

A front area and back area of the box lug 108 are open, allowing access to an interior of the box lug 108. These openings allow the fuse clip member 104 to be inserted and allow the box lug 108 to move up or down relative to the fuse clip member 104. In an alternative exemplary embodiment (not shown), the front area and back area can have partial walls that restrict the movement of the fuse clip member 104 with respect to the box lug 108.

FIG. 4B also depicts a fastener aperture 402 in a top surface of the box lug 108. The fastener aperture 402 comprises threads (or simply a suitable thickness that acts as a thread) to threadably engage corresponding threads on the fastener 110 (FIG. 1).

Although the pressure plate 108*a* is depicted in FIG. 4B as a continuous member, the apertures 304*a*, 304*b* can be connected across the pressure plate 108*a* such that the pressure plate 108*a* includes a gap extending from side wall 306*a* to side wall 306*b*. In this embodiment, the projection 302 of the pressure plate 104*a* of the fuse clip member 104 can extend into the gap when the pressure plate 108*a* of the box lug 108 is moved to the closed position, thereby providing increased holding strength for a conductor crimped between the pressure plates 104*a*, 108*a*.

Figure 5:
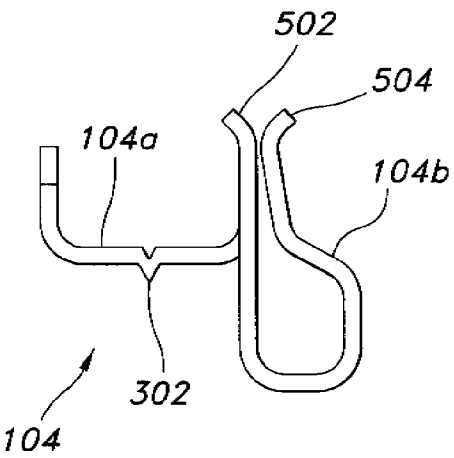
FIG. 5 is a side elevation of a fuse clip member of the wiring lug according to one exemplary embodiment of the invention.

FIG. 5 is a side elevation of the fuse clip member 104 according to one exemplary embodiment of the invention. The two major sections of the fuse clip member 104 are the pressure plate 104*a* and the fuse clip 104*b*. The fuse clip 104*b* comprises a first portion 502 and a second portion 504 of a continuous member. The second portion 504 is bent toward the first portion 502 to form the fuse clip 104*b*. The pressure plate extends substantially perpendicularly to the first portion 502 of the fuse clip 104*b*. The pressure plate 104*a* comprises the projection 302 and can secure an electrical lead (not shown) between the fuse clip member 104 and the box lug 108 (FIG. 3).

Figure 6C:
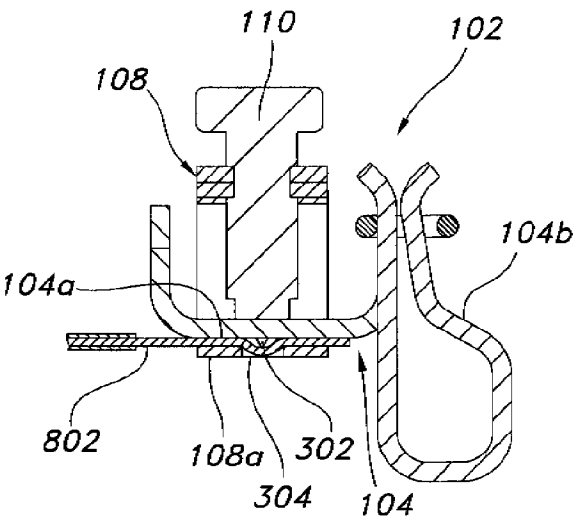
FIG. 6C is a cross sectional view of the wiring lug illustrated in FIG. 6B, where the wiring lug has received an electrical lead and is in a second, closed position according to one exemplary embodiment of the invention.

The operation of a wiring lug being operated from the open position to the closed position will now be described with reference to FIGS. 6A-6C. FIG. 6A is a cross sectional view of the wiring lug 102 depicted in FIG. 3, where the wiring lug 102 is in the first, open position according to one exemplary embodiment of the invention. The wiring lug 102 comprises the box lug 108 operably coupled to the fuse clip member 104 such that one or both of those components may move with respect to each other. When in the first position, the box lug 108 may be moved up or down with respect to the fuse clip member 104.

Figure 6B:
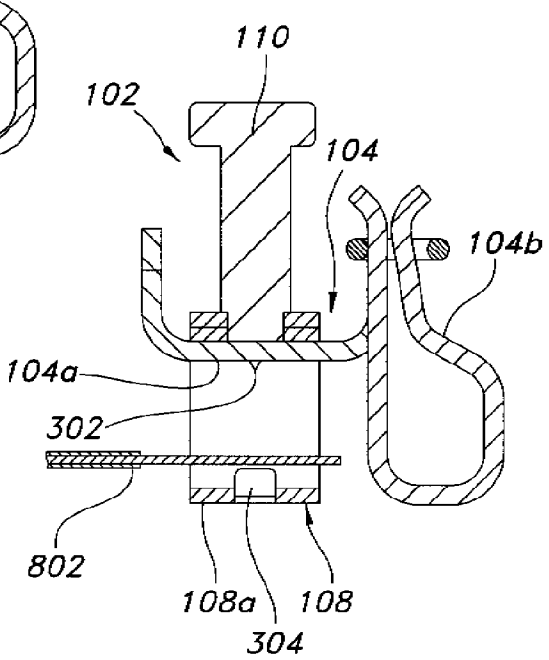
FIG. 6B is a cross sectional view of the wiring lug illustrated in FIG. 6A, where the wiring lug is receiving an electrical lead while in the first, open position according to one exemplary embodiment of the invention.
Figure 6A:
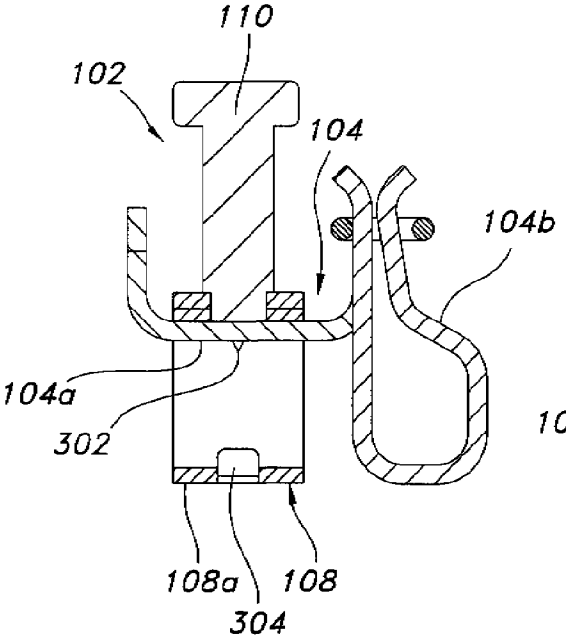
FIG. 6A is a cross sectional view of the wiring lug illustrated in FIG. 3, where the wiring lug is in a first, open position according to one exemplary embodiment of the invention.

FIG. 6B is a cross sectional view of the wiring lug 102 illustrated in FIG. 6A, where the wiring lug 102 is receiving an electrical lead 802 while the wiring lug 102 is in the first, open position according to one exemplary embodiment of the invention. FIG. 6C is a cross sectional view of the wiring lug 102 illustrated in FIG. 6A, where the wiring lug 102 has received an electrical lead 802, such as a conductor, and is in the second, closed position according to one exemplary embodiment of the invention. In FIG. 6C, the fastener 110 has been rotated to move the box lug 108 with respect to the fuse clip member 104, such that the electrical lead 802 is crimped between the pressure plate 104*a* of the fuse clip member 104 and the pressure plate 108*a* of the box lug 108.

In the exemplary embodiment previously described, the rotation of the fastener 110 from a first position to a second position causes the pressure plate 108*a* from the box lug 108 to move closer to the pressure plate 104*a*, which is in a fixed position. In an alternative exemplary embodiment (not shown), the rotation of the fastener 110 from a first position to a second position may cause the pressure plate 104*a* to move toward the pressure plate 108*a* of the box lug 108, which can be in a fixed position.

As previously discussed, the fuse clip member 104 comprises at least one projection 302. Each projection can correspond to an aperture 304 in the box lug 108. In an exemplary embodiment, the projection 302 may be smaller than the aperture 304 in the base of the box lug 108. This projection 302 and aperture 304 may act to further restrict the movement of the electrical lead 802 installed in the wiring lug 102 by introducing a roughness that aids in restricting the electrical lead 802 in the wiring lug 102. The projections 302 can allow for a more secure connection of the electrical lead 802 to the wiring lug 102 with lower torque applied to the screw fastener 110 to secure the electrical lead 802.

By use of the pressure plates 104*a*, 108*a*, the electrical lead 802 is in contact with the fuse clip member 104 for substantially the length of the pressure plate 104*a* where the electrical lead 802 is in contact with the pressure plate 104*a*. This contact allows more of the electrical lead 802 to be in contact with the terminal and removes the single physical point of contact between the electrical lead 802 and the pressure plate 104*a*. The pressure plate 104*a* acts as the entire contact surface. In addition, with more surface area in contact, the electrical connection is more secure. Furthermore, the distribution of the contact between the electrical lead 802 and the pressure plate 104*a* reduces generated heat.

Figure 7A:
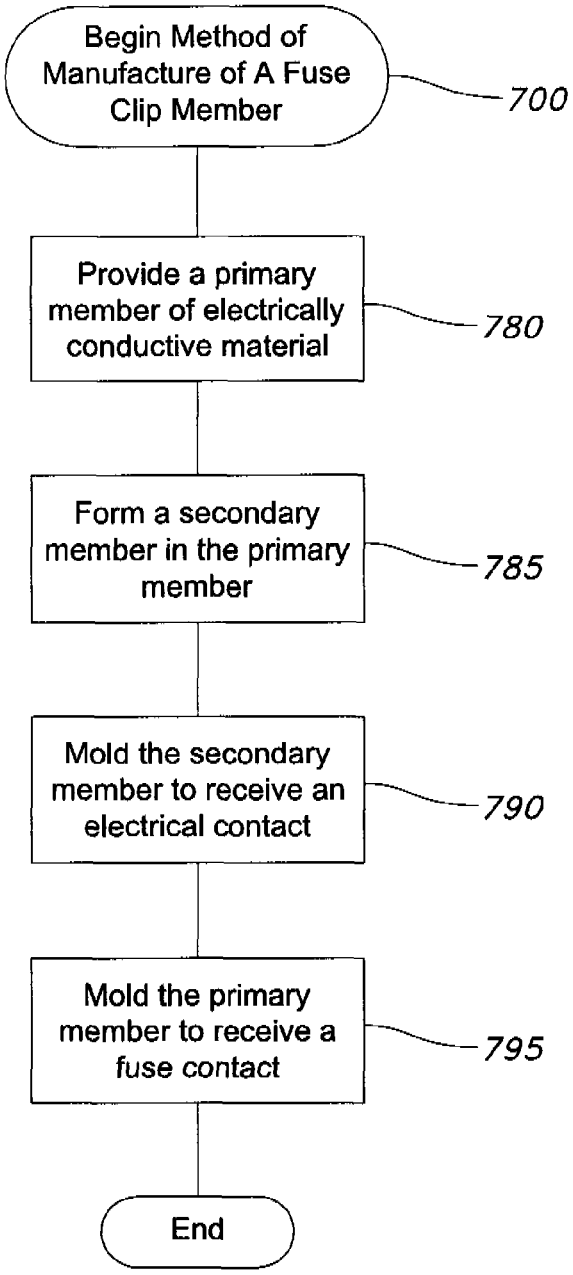
FIG. 7A is a flowchart illustrating a method for manufacturing a fuse clip member according to one exemplary embodiment of the invention.

With reference to FIGS. 7A-7H, an exemplary method for manufacturing the fuse clip member 104 from a single piece of conductive material will be described. FIG. 7A is a flowchart illustrating a method 700 for manufacturing the fuse clip member 104 according to one exemplary embodiment.

The method 700 includes providing a primary member of electrically conductive material as shown in step 780. The primary member then has a secondary member formed therein as shown at step 785. The secondary member is then molded to receive an electrical contact at step 790, and the primary member is molded to receive the fuse contact at step 795. The method 700 described in FIG. 7A is illustrated in FIGS. 7B-7H and described in the following paragraphs.

Figures 7B, 7C, 7D, 7E:
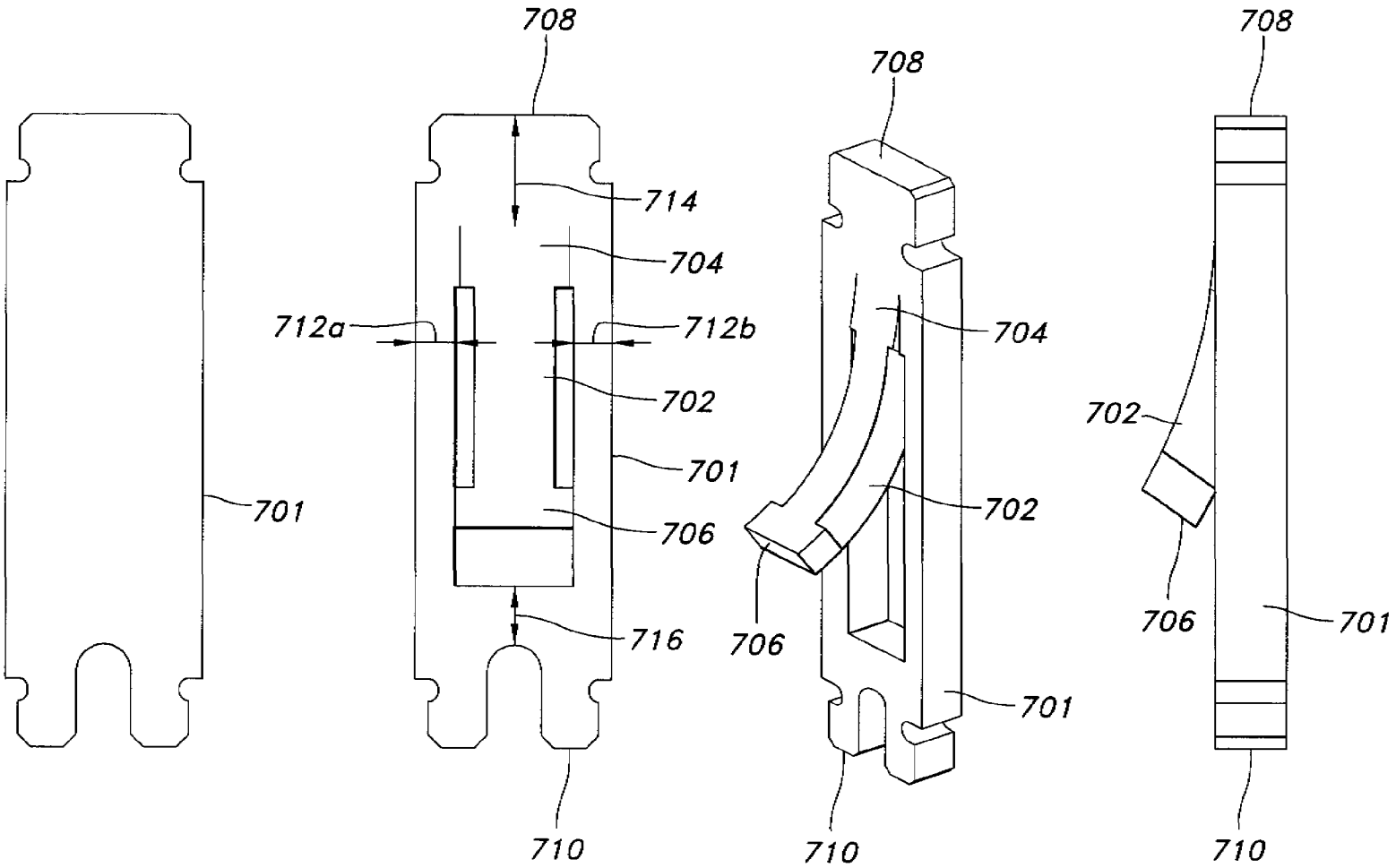
FIG. 7B is a front elevation view of a material blank for forming the fuse clip member of FIG. 6 using the method of FIG. 7A according to one exemplary embodiment of the invention.
FIGS. 7C-7H are views of the formation of the fuse clip member from the blank illustrated in FIG. 7B according to the method depicted in FIG. 7A according to one exemplary embodiment of the invention.

FIG. 7B is a front elevation view of the fuse clip member 104 from FIG. 6 in its unprocessed state, where the fuse clip member 104 comprises only a primary member 701 of conductive material according to one exemplary embodiment of the invention. In an exemplary embodiment, the fuse clip member 104 may be made entirely from a single piece of conductive material that has a substantially rectangular shape. The conductive material used in the exemplary embodiment may C110 copper or any other suitable conductive material. An advantage of C110 copper is that it does not require the use of a hydraulic press to bend it into the desired shape. Bending may be accomplished by a person using simple hand tools if needed. An additional advantage of the method 700 is that is allows the use of conductive materials that do not need to have inherent spring properties as the method of manufacture creates the spring properties used in the invention.

FIG. 7C is a front elevation view of the primary member 701 from FIG. 7B, where a rectangular projection is made from the primary member 701, creating a secondary member 702. The secondary member 702 has three sides physically separated from the primary member 701 and one side still coupled to the primary member 701 at the secondary member proximal end 704. The width of the secondary member 702 is a first predetermined distance 712*a*, 712*b* from the sides of the primary member 701. The length of the secondary member 702 is defined by the secondary member proximal end 704 and secondary member distal end 706. The secondary member proximal end 704 starts at a second predetermined distance 714 from the primary member proximal end 708. The secondary member distal end 706 is formed at a third predetermined distance 716 from the primary member distal end 710. The secondary member 702 may be defined by decoupling the secondary member distal end 706 from the primary member 701. Decoupling maybe accomplished by any means known to those having ordinary skill in the art, including cutting or stamping. Such (decoupling would allow all but the secondary member proximal end 704 to move relative to the primary member. The secondary member 702 remains coupled to the primary member 701 at the secondary member proximal end 704.

FIG. 7D is a partial elevation view of the primary member 701 and the secondary member 702 from FIG. 7C, where the secondary member distal end 706 has been separated from the primary member 701 according to one exemplary embodiment of the invention. FIG. 7E is a side elevation view of the primary member 701 and the secondary member 702 from FIG. 7C, where the secondary member distal end 706 has been separated from the primary member 701 according to one exemplary embodiment of the invention.

Figure 7H:
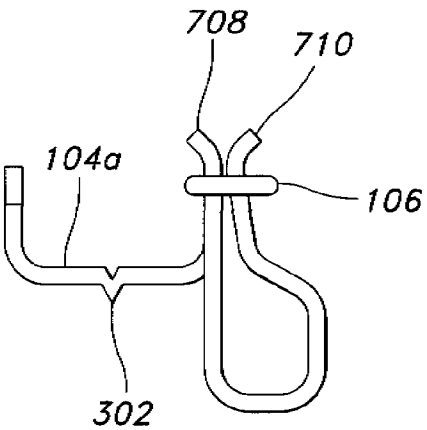
Figure 7G:
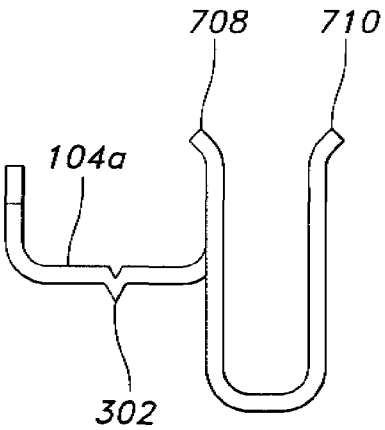
Figure 7F:
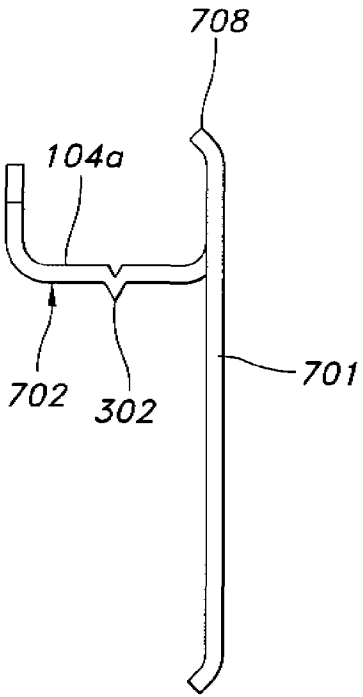

FIG. 7F is a side elevation view of the primary member 701 and the secondary member 702 from FIG. 7E, where the secondary member 702 has been extended away from the primary member 701 to become substantially perpendicular to the primary member 701, forming the pressure plate 104*a* according to one exemplary embodiment of the invention. According to an exemplary embodiment, an additional deformation in the pressure plate 104*a* may be made by forming the projection 302 in the pressure plate 104*a*. The location of the projection 302 may correspond to the projection aperture 304 in the box lug 108. A single projection 302 or multiple projections can be made. A single projection 302 can be formed on an edge of the pressure plate 104*a* or can be continuous across the pressure plate 104*a*.

FIG. 7G is a side elevation view of the primary member 701 and the secondary member 702 from FIG. 7F, where the primary member distal end 710 has been bent away from the pressure plate 104*a* to be substantially proximate to the primary member proximal end 708 according to one exemplary embodiment of the invention. FIG. 7H is a side elevation view of the primary member 701 and the secondary member 702 from FIG. 7G, where the primary member distal end 710 and the primary member proximal end 708 are coupled by a backing spring 106, thereby creating a fuse clip 104*b* according to one exemplary embodiment of the invention.

Any spatial references herein, such as, for example, "upper," "lower," "above," "below," "rear," "between," "vertical," "angular," "beneath," "top," "bottom," "side," etc., are for the purpose of illustration only and do not limit the specific orientation or location of the described structure.

Therefore, the invention is well adapted to attain the ends and advantages mentioned as well as those that are inherent therein. The particular embodiments disclosed above are illustrative only, as the invention may be modified and practiced in different but equivalent manners apparent to those having ordinary skill in the art and having the benefit of the teachings herein. While numerous changes may be made by those having ordinary skill in the art, such changes are encompassed within the spirit and scope of this invention as defined by the appended claims. Furthermore, no limitations are intended to the details of construction or design herein shown, other than as described in the claims below. It is therefore evident that the particular illustrative embodiments disclosed above may be altered or modified and all such variations are considered within the scope and spirit of the invention as defined by the claims below. The terms in the claims have their plain, ordinary meaning unless otherwise explicitly and clearly defined by the patentee.

What is claimed is:

1. A method of manufacturing a fuse module including a fuse clip member, the fuse clip member fabricated from a single, substantially planar piece of electrically conductive material, the method comprising:

partially decoupling a portion of the single piece from a remaining portion of the single piece;

extending the decoupled portion out of the plane of the single piece;

shaping the remaining portion into a fuse clip having a pair of arms and a base extending between the arms; and shaping the decoupled portion into a pressure plate including a distal end extending substantially parallel to one of the arms and substantially perpendicular to the base.

2. The method of claim 1, wherein shaping the remaining portion into a fuse clip comprises gathering opposing ends of the arms proximate one another, and coupling the opposing ends with a backing spring.

3. The method of claim 2, the fuse module further including a housing defining a fuse terminal aperture, the method further comprising situating the gathered ends in the housing beneath the fuse terminal aperture.

4. The method of claim 1, wherein shaping the decoupled portion into a pressure plate further comprises orienting a section of the decoupled portion to extend substantially parallel to the base and substantially perpendicular to the one of the arms.

5. The method of claim 1, further comprising assembling the pressure plate with a box lug and a securing member, wherein the securing member when operated causes the box lug to move relative to the pressure plate.

6. The method of claim 5, the fuse module further including a housing defining a terminal access opening, the terminal access opening in the housing having a first diameter, wherein assembling the pressure plate with a box lug and a securing member further comprises assembling the pressure plate with a box lug and a securing member having a second diameter larger than the first diameter, and the method further comprising:

situating the securing member in the housing so that the securing member is held by the housing in a predetermined position relative to the pressure plate proximate the terminal access opening.

7. The method of claim 5, the fuse module further including a housing, the method further comprising mounting the pressure plate in a fixed position in the housing.

8. The method of claim 7, the housing defining at least one electrical lead aperture, and the method comprising locating the box lug in the housing in communication with the electrical lead aperture in at least one operating position.

9. The method of claim 5, wherein the pressure plate is formed to extend at a predetermined distance from the base such that the box lug is movable relative to the pressure plate into a position in which the box lug extends across the entire predetermined distance.

10. The method of claim 1, wherein shaping the remaining portion into a fuse clip comprises forming a loop from the remaining portion, and gathering opposing ends of the arms such that a fuse blade is receivable therebetween.

11. The method of claim 10, wherein the pressure plate is formed to extend at an elevation spaced from the base and spaced from the gathered ends of the arms.

12. A method of manufacturing a fuse module comprising:

providing a housing including at least one electrical lead aperture;

providing an integral fuse clip and first pressure plate that are formed from a single, substantially planar piece of electrically conductive material;

assembling the first pressure plate with a box lug and a securing member such that the box lug defines an interior space with a second pressure plate, wherein the securing member when operated causes the box lug to move relative to the first pressure plate; and mounting the first pressure plate, the box lug, and the securing member to the housing such that operation of the securing member causes the box lug to move relative to the housing, whereby the box lug is movable between a first position and a second position relative to the first pressure plate such that the interior space may selectively communicate with the at least one electrical lead aperture, and wherein the interior space of the box lug is inaccessible from the at least one electrical lead aperture in the first position and is accessible from the at least one electrical lead aperture in the second position.

13. The method of manufacturing a fuse module according to claim 12, the housing further including at least one terminal access opening, the method further comprising mounting the securing member in a position to be accessed via the at least one terminal access opening.

* * * * *